US009206544B2

(12) United States Patent
Zeng et al.

(10) Patent No.: US 9,206,544 B2
(45) Date of Patent: Dec. 8, 2015

(54) CHAIN, CONTINUOUS AND NO-WASTE METHOD FOR DEGUMMING AND FIBER-SEPARATING THE RAMIE

(71) Applicant: WUHAN TEXTILE UNIVERSITY, Wuhan, Hubei (CN)

(72) Inventors: Qingfu Zeng, Hubei (CN); Gongbing Su, Hubei (CN); Xuejun Long, Hubei (CN); Fei Pan, Hubei (CN); Haiying Chen, Hubei (CN); Qian Wang, Hubei (CN); Honggao Chen, Hubei (CN); Yongming Cui, Hubei (CN); Ping Zhang, Hubei (CN); Jin Li, Hubei (CN); Jun Wang, Hubei (CN)

(73) Assignee: WUHAN TEXTILE UNIVERSITY, Wuhan, Hubei (CN)

( * ) Notice: Subject to any disclaimer, the term of this patent is extended or adjusted under 35 U.S.C. 154(b) by 0 days.

(21) Appl. No.: 14/466,622

(22) Filed: Aug. 22, 2014

(65) Prior Publication Data

US 2015/0240414 A1 Aug. 27, 2015

(30) Foreign Application Priority Data

Feb. 25, 2014 (CN) ..... 2014 1 0064305

(51) Int. Cl.

| | |
|---|---|
| ***D06M 16/00*** | (2006.01) |
| ***D21C 9/10*** | (2006.01) |
| ***D21C 9/16*** | (2006.01) |
| *D06M 101/06* | (2006.01) |

(52) U.S. Cl.

CPC ..... *D06M 16/003* (2013.01); *D21C 9/10* (2013.01); *D21C 9/163* (2013.01); *D06M 2101/06* (2013.01)

(58) Field of Classification Search

CPC ..... D01C 1/00; D01C 1/02; D01C 1/04; D01C 3/11; D06L 1/22; D06L 1/14; D06L 3/10; D06L 3/16; D21C 11/00; D21C 9/10; D21C 9/163; D06M 16/00; D06M 16/003; D06M 2101/06

See application file for complete search history.

(56) References Cited

U.S. PATENT DOCUMENTS

| | | | | | |
|---|---|---|---|---|---|
| 4,481,355 | A * | 11/1984 | Jaskowski | ..... | 536/2 |
| 4,568,739 | A * | 2/1986 | Jaskowski | ..... | 536/2 |
| 4,617,383 | A * | 10/1986 | Jaskowski | ..... | 536/2 |
| 7,481,844 | B2 * | 1/2009 | Liu et al. | ..... | 8/138 |
| 7,892,397 | B2 * | 2/2011 | Luo et al. | ..... | 162/29 |
| 8,591,701 | B2 * | 11/2013 | Sung et al. | ..... | 162/49 |
| 2004/0191888 | A1 * | 9/2004 | Clarke et al. | ..... | 435/263 |
| 2015/0240414 | A1 * | 8/2015 | Zeng | ..... | D06M 16/003 435/277 |

FOREIGN PATENT DOCUMENTS

| | | | | |
|---|---|---|---|---|
| CN | 85103481 | B | | 9/1988 |
| CN | 1036537 | C | | 11/1997 |
| CN | 1177003 | A | | 3/1998 |
| CN | 1131926 | C | | 12/2003 |
| CN | 101187067 | A | * | 5/2008 |
| CN | 101423983 | A | * | 5/2009 |
| CN | 102094249 | A | * | 6/2011 |
| CN | 102191566 | A | * | 9/2011 |
| CN | 101684571 | B | * | 7/2012 |
| CN | 101787570 | B | * | 1/2013 |
| CN | 103114338 | A | * | 5/2013 |
| CN | 103132153 | A | * | 6/2013 |
| CN | 103774245 | A | * | 5/2014 |
| CN | 103835001 | A | * | 6/2014 |
| EP | 2703527 | A1 | * | 3/2014 |
| IN | 200900371 | I3 | * | 10/2010 |
| WO | WO 2007037711 | A1 | * | 4/2007 |

* cited by examiner

*Primary Examiner* — Jose Fortuna

(74) *Attorney, Agent, or Firm* — Tim Tingkang Xia, Esq.; Locke Lord LLP

(57) ABSTRACT

The present invention relates to a chain, continuous and no-waste method for degumming and fiber-separating the ramie, including anaerobic circle step, in which the raw fibers after the waste alkali bath step are immersed in the anaerobic water pool; aerobic circle step, in which the raw fibers after the anaerobic circle step are immersed in the aerobic water pool; alkali-hydrogen peroxide one bath scouring-bleaching step, in which the raw fibers after the aerobic circle step are immersed in a combined solution of NaOH and $H_2O_2$; and the treatment by a fiber-separating and washing device followed by the immersion in the cellulase solution. In the present invention, the ramie degumming process and the degumming wastewater treatment are performed integratively, and the degumming wastewater is completely recycled after treatment.

6 Claims, 8 Drawing Sheets

CHAIN, CONTINUOUS AND NO-WASTE METHOD FOR DEGUMMING AND FIBER-SEPARATING THE RAMIE

CROSS-REFERENCE TO RELATED APPLICATION

This application claims the priority to Chinese Patent Application No. CN201410064305.9, filed Feb. 25, 2014, in the State Intellectual Property Office of P.R. China, which is hereby incorporated herein in its entirety by reference.

FIELD

The present invention belongs to the ramie technical field and relates to, in particular, a method for degumming the ramie phloem fibers.

BACKGROUND

Global fossil resources are going to be exhausted, and the environmental pollution is increasingly severe. Solving the problems of the resources and environment is the important task for the economic sustainable development in 21$^{st}$ century. However, the chemical fibers with petroleum as the starting material comprise about 67% in the total amount of the textile industry in China, the yield of which is over 50% in the world. It will be faced a severe problem in ensuring the petroleum supply in a long term and steadily. It has been an international trend to change the present situation that the petroleum resources are deeply relied on by the chemical fiber industry in China or even the world, and develop the utilization of the natural fibers. 2009 has been designated as the "International Year of Natural Fibers". The usage of natural fibers has increased by 8% and 15% every year in the world and China, respectively. The yield of cotton, the main natural fibers in China, is about 6 million tons per year with a gap of about 6 to 8 million tons that is not likely to be compensated by planting cotton in the cereals cropland instead. The productivity has reached the plateau for other natural fibers in China, such as silk and wool, both of which have a yield of 100,000 tons per year. The bast fiber crops are cultivated in extensive conditions and suitable to be planted in various places, and have a great potential to be developed in the industrial scale. The most advantageous bast fiber crop is ramie. From of old, ramie is the typical crop mainly used in textile in China and known as "China grass" overseas. China has 90% of the ramie yield in the world and extremely high international competitive capacity that 80% of the ramie products are outputted to comprise over 60% of the global textile trade volume. There are 459 relatively large ramie textile and/or ramie textile manufacturing enterprises in China, offering nearly 1 million jobs.

The ramie industry is the traditional national industry in China and belongs to the labour intensive industries. In China, the employees in the ramie industry chain are up to several millions. The ramie dress has the advantages such as being stiff and neat, elegant, light, cool, breathable and anti-bacterial, and belongs to top grade consumer goods. The utilization of ramie fiber resources is turning from the traditional textile field to the biomass energy sources and biomaterials. Both the ramie materials and the ramie products have a broad market prospect.

The degumming of the ramie is an important step in the ramie processing. At present in China, most of the ramie processing enterprises adopt the chemical degumming, involving acid immersing, alkali boiling, and hammering-and-washing steps, which not only renders the degumming process long, the process steps complicated, the energy and water consumption high, and the pollution severe, but also causes damage to the ramie fibers and lowers the fiber quality. The biological degumming is focused in the clean production technology studies of the phloem fibers of the bast fiber crops at home and abroad, and is by the mechanism that the microorganisms and their secreted extracellular enzyme(s) are utilized to allow a series of reactions occur in relatively mild conditions so as to degrade the ramie phloem gum and release the fibers. The biological degumming is believed to be most possibly used in production practice in place of chemical degumming due to the avoidance of strong acids and alkalis, saving energy and water and little environmental pollution. The biological degumming of the ramie has been studied for over 80 years in China. Mainly, the superior degumming bacteria are screened from the nature and incubated into high-efficient degumming strains by physical or chemical mutagenesis, and then, the scaled-up bacterium-and-enzyme mixed liquor or the critical degumming enzyme(s) isolated therefrom is used for degumming. In the past decades, a number of degumming bacteria have been obtained from the microorganism resources, wherein the *Erwinia carotovora* strain T85-260 screened by the Institute of Bast Fiber Crops, Chinese Academy of Agricutral Sciences, the *Bacillus alcalophilus* strain screened by Wuhan University, the *Bacillus alcalophilus* strain screened by Shandong University, and the wild *Bacillus cereus* strain screened by Qingdao Continent Biotech Co., Ltd have ever been proceeded to the production test stage, and the others are still in the laboratory stage.

In the last 90s, the commercial production test has been performed for the biological degumming technologies. The patent "A technology for degumming the ramie jointly by bacteria and chemistry" (CN85103481) has been extended in 5 enterprises, and the patent "A process and equipment for biologically degumming the ramie" (CN95112564.8) has been tested for production in 6 enterprises including the Number 2 and 3 Ramie Textile Factories of Ruanjiang City, Hunan Province. The attempts failed mainly because the seed production technology is difficult to be mastered and the degumming capacity is not sufficient. The patent CN01106884.2 has been tested in Number 2 Ramie Textile Factory of Ruanjiang City, and the patent CN97109044.0 has been tested for production in Jiangxi Enda Hometextile Co., Ltd. These tests were in the joint manner of biological-and-chemical degumming. The large-scale production test of purely biological degumming was started in 2007 in the Star Textile Factory of Ruanjiang, Hunan. However, it has now been forced to change to joint biological-and-chemical degumming, which is mainly because the degummed ramie by purely biological degumming is not ideal and the products produced using the same are not welcome in the market.

SUMMARY OF THE INVENTION

The technical problem to be solved by the present invention is to provide a chain, continuous and no-waste technology for degumming and fiber-separating the ramie, which solves the problems resulted from the discharge of the residual liquid after the traditional batch single-tank treatment, such as high consumption of chemicals and the production of highly concentrated wastewater, to reach the bast fiber processing with zero discharge and solve the problems, such as high consumption of water and severe pollution, in the existing ramie degumming process.

The present invention solves the technical problem by the following solution:

A chain, continuous and no-waste method for degumming and fiber-separating the ramie according to the present invention, including:

(1) waste alkali bath step, in which the raw fibers are immersed in the alkaline wastewater discharged from the alkali-hydrogen peroxide one bath scouring-bleaching at ambient temperature for 8 h;

(2) anaerobic circle step, in which the raw fibers treated in the waste alkali bath are immersed in the anaerobic water pool in a bath ratio of 1:15 to 25, and washed at ambient temperature for 8 h;

(3) aerobic circle step, in which the raw fibers washed in the anaerobic water pool are immersed in the aerobic water pool in a bath ratio of 1:15 to 25, and washed at ambient temperature for 8 h;

(4) alkali-hydrogen peroxide one bath scouring-bleaching step, in which the raw fibers treated in the aerobic circle step are immersed in a solution comprising 1 to 10 g/L NaOH and 0 to 2 g/L $H_2O_2$ in a bath ratio of 1:15 to 25, and reacted at the temperature of 70 to 100° C. for 2 h;

(5) fiber-separating and washing step, in which the raw fibers washed in the alkali-hydrogen peroxide one bath scouring-bleaching step are treated by the fiber-separating and washing device with a washing time of 4 h, which step can be performed either by rolling and rubbing manually or in a mechanical way;

(6) bio-enzyme washing step, in which the raw fibers treated in the fiber-separating and washing step are immersed in a solution having a cellulose concentration of 5 to 30 U in a bath ratio of 1:15 to 25 and reacted at the temperature of 55° C. for 2 h to reach the no-waste degumming and fiber-separating of the raw ramie fibers, depending on the quality requirements.

According to the present invention, a disc is used as the device units in a chain connection in the process of the no-waste degumming and fiber-separating of the raw ramie fibers, rendering a continuous operation; the ramie degumming process and the degumming wastewater treatment are performed integratively, and the effluent from the alkali-hydrogen peroxide one bath scouring-bleaching is introduced into the waste alkali bath and used for the immersion of the raw fibers; the water used in the anaerobic washing step is circulated with the anaerobic pool for sewage treatment; the water used in the aerobic washing step is circulated with the aerobic pool for sewage treatment; the effluents from the waste alkali bath, fiber-separating and washing, and bio-enzyme washing are recycled after treatment in the sewage treatment system, and no sewage is discharged.

The effluent from the alkali-hydrogen peroxide one bath scouring-bleaching is highly polluted wastewater, and a majority of the COD therein can be precipitated by flocculation after being used in the waste alkali bath, to form the sludge to be treated separately, and the supernatant is then discharged into the sewage treatment system so as to reduce the load of the subsequent sewage treatment system.

The degumming process is a continuous disk operation, and the chemicals in the alkali-hydrogen peroxide one bath scouring-bleaching step can be repeatedly used for many times to reduce the discharge of the degumming chemicals every time.

The soluble gum can be partially squeezed out from the ramie in the mechanical squeezing and water flow washing process to fiber-separate the raw fibers partially.

The cellulase is a normal cellulase, an acidic cellulase, a neutral cellulase or an alkaline cellulase, and not limited by the pH value.

The fiber-separating and washing device can be the ramie fiber back washing device Model ZMXFC-1 developed jointly by Wuhan Textile University and Xinnong Ramie Co., Ltd.

The present invention has the following advantages as compared to the prior art:

1) The existing chemical degumming process is a batch operation, and the solution containing sodium hydroxide and degumming aids is discharged directly every time after the completion of degumming, which leads to the failure of recycling the degumming chemicals and the discharge of a large amount of highly concentrated wastewater. The degumming process of the present invention is a continuous disc operation, and the chemicals in the alkali-hydrogen peroxide one bath scouring-bleaching step are repeatedly used for many times, which reduces the discharge of the degumming chemicals every time, and perform the step with most severe pollution separately to reduce the load of the subsequent sewage treatment systems.

The separate performation of the step with most severe pollution in the degumming process reduces the difficulty of treating the wastewater coupled with the same. The effluent from the alkali-hydrogen peroxide one bath scouring-bleaching is highly polluted wastewater, and a majority of the COD therein are precipitated by flocculation after being used in the waste alkali bath, to form the sludge to be treated separately, and the supernatant is then discharged into the sewage treatment system so as to reduce the COD concentration in the influent of the degumming wastewater treatment system and reduce the treatment difficulty and the treatment cost.

2) The existing biological degumming process suffers from the product homogeneity problem because the seed activation, amplifying culture, and degumming needs to be performed again in every degumming, which cannot ensure the complete consistency between the seed concentrations used in every time and thus results the significantly different batches of degummed ramie by biological degumming. In the present invention, the water used in the anaerobic washing step is circulated with the anaerobic pool for sewage treatment, and the water used in the aerobic washing step is circulated with the aerobic pool for sewage treatment. Since the degumming wastewater treatment is continuously performed, the anaerobic and aerobic washing steps not only wash away partially the alkali liquid on the raw ramie fiber left after the waste alkali bath step, but also have the effect of the biological treatment, without suffering from the homogeneity problem of the microorganism treatment.

3) The severe pollution problem with the ramie degumming is solved. For the production of every one ton of the degummed ramie, the present method discharges barely the degumming wastewater and reaches the raw ramie fiber degumming process with zero discharge as compared to the discharge of 500 tons of wastewater for the production of one ton of the degummed ramie in the traditional degumming processes.

4) The present invention uses a disc as the degumming device unit and connects each of the degumming steps by a chain to degum continuously. The degumming is performed in a coupled physical, chemical, and biological way and the degumming operation is performed gradually. The degumming efficiency is improved and the degumming cost is reduced.

In a word, the ramie degumming process and the degumming wastewater treatment are performed integratively according to the present invention. The degumming wastewater is entirely recycled after treatment, without sewage discharge.

Figure 1:
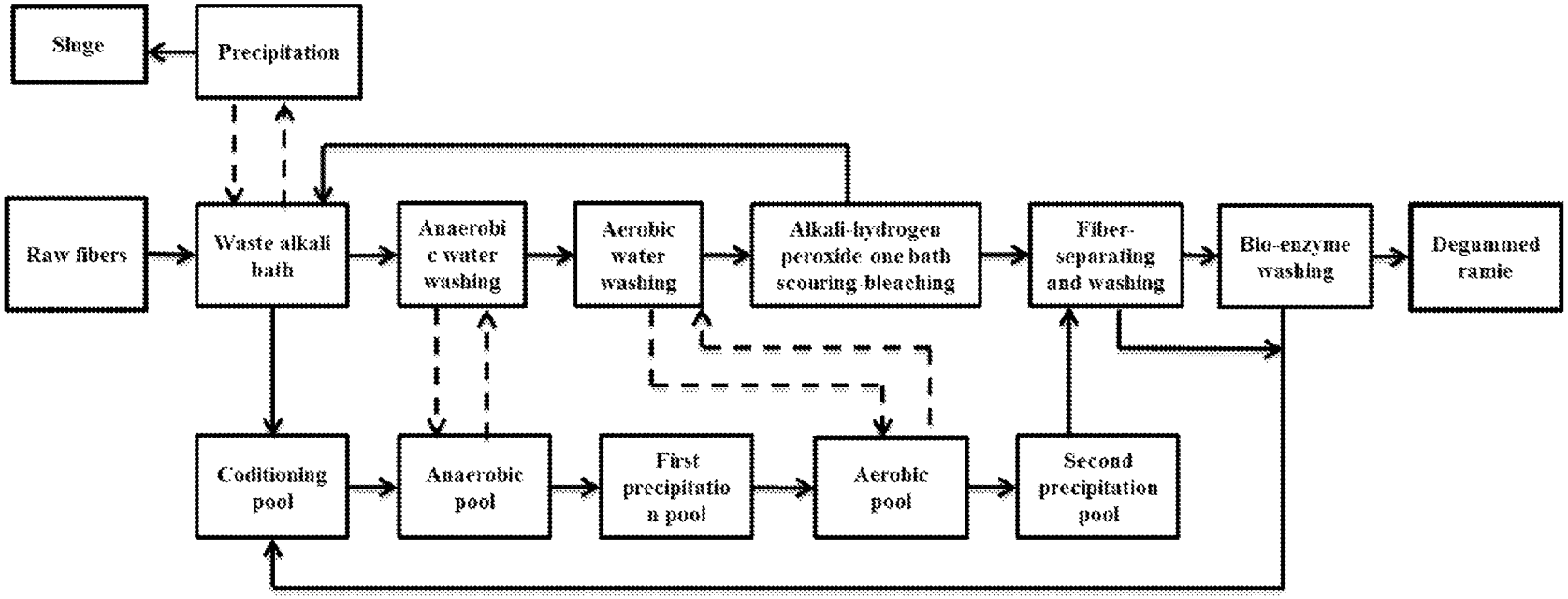
FIG. 1 is a schematic view of the process flow of the chain, continuous and no-waste technology for degumming and fiber-separating the ramie according to the present invention.
Figure 2:
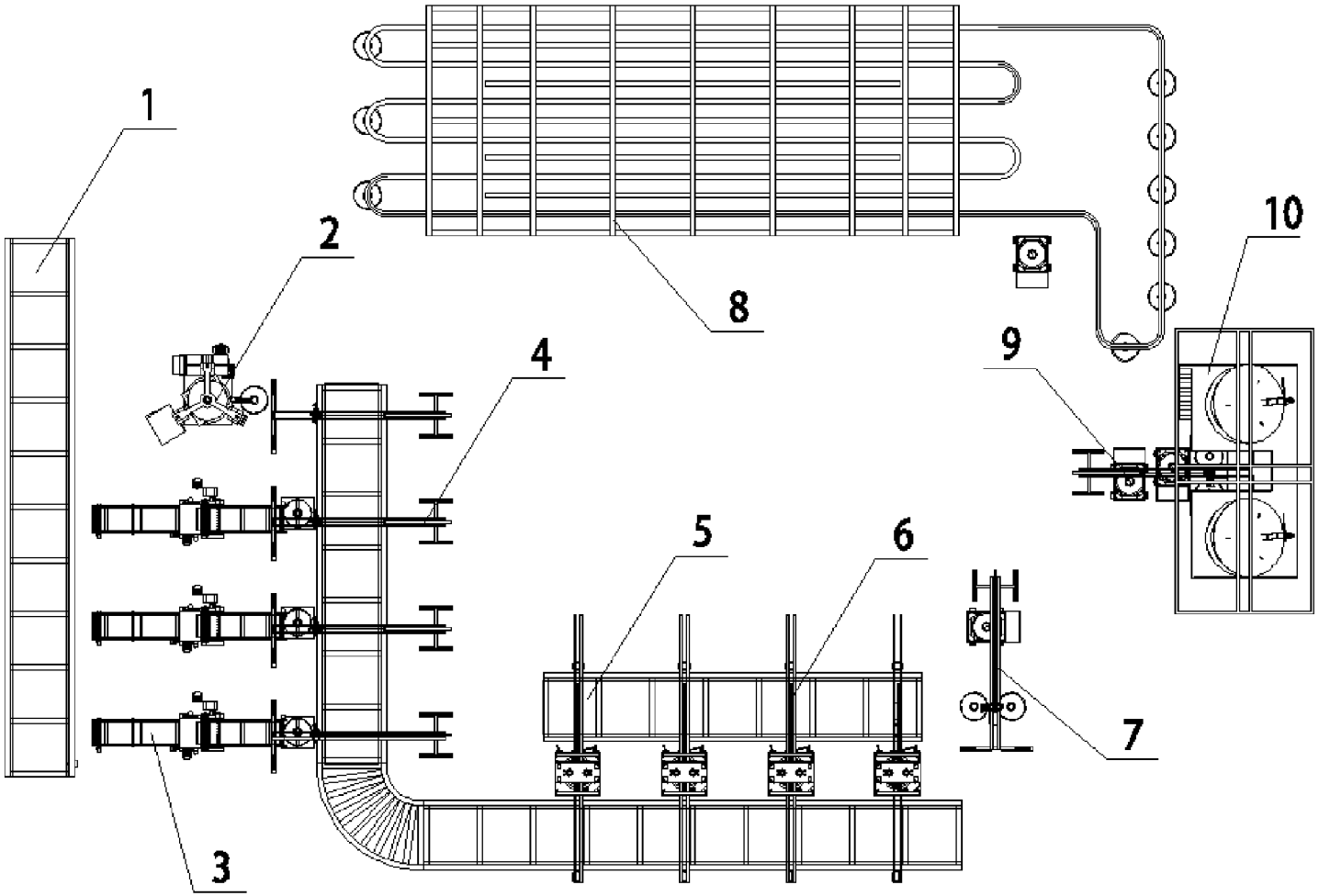
FIG. 2 is a schematic view of the structure of the production line.
Figure 3:
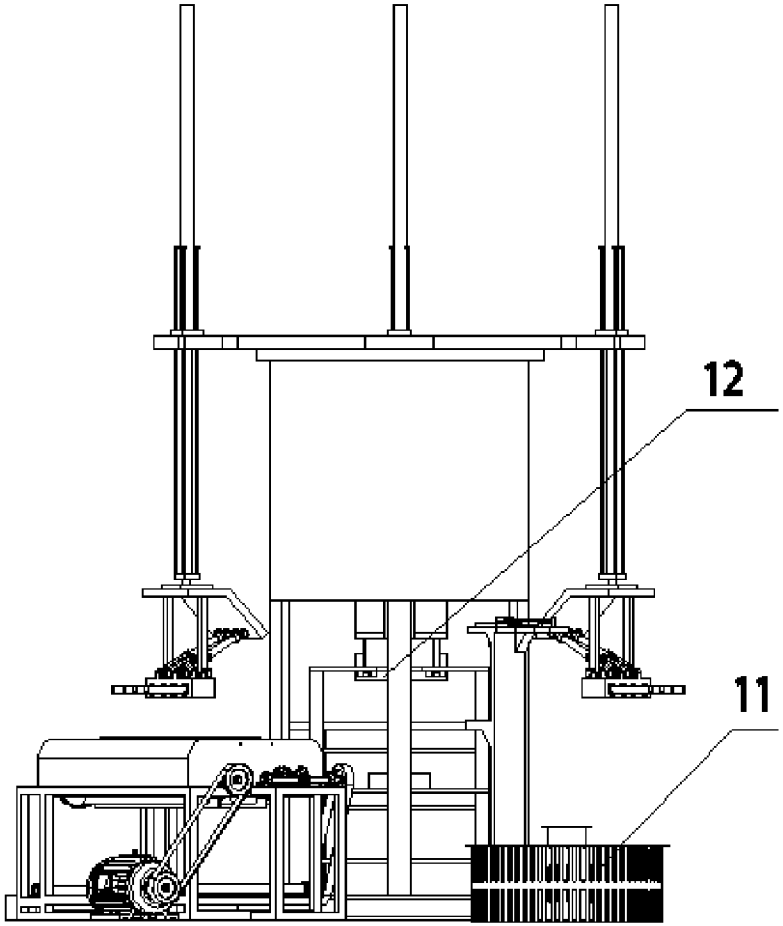
FIG. 3 is a schematic view of the sequencing batch decorticator in FIG. 2.

In the figures: 1. ramie sorting platform; 2. sequencing batch decorticator; 3. automatic ramie stem separation machine; 4. first mechanical hand; 5. roller type transport platform; 6. stamping machine; 7. second mechanical hand; 8. degumming and washing device; 9. third mechanical hand; 10. ramie fiber back washing device; 11. bast fiber collecting frame of the sequencing batch decorticator; 12. stem inlet of the sequencing batch decorticator; 13. stem inlet of the automatic ramie stem separation machine; 14. bast fiber collecting and transporting configuration of the automatic ramie stem separation machine; 15. L type roller type transport platform; 16. I type roller type transport platform; 17. squeezing platform of the stamping machine; 18. mechanical hand of the stamping machine; 19. degumming and washing pool; 20. chaining transport device; 21. ramie fiber cleaning tank; 22. trolley.

DETAILED DESCRIPTION OF THE INVENTION

The present invention adopts the apparatus shown in FIGS. 2-8. This apparatus is an automatic degummed ramie production line used for separating the boon, bark and fiber layer of the ramie and degumming and fiber-separating, and washing and recovering the ramie fibers. In this production line, ramie is firstly sorted and transported by the sorting unit. The peeling unit peels off the bast fibers from the boon and collects the same separately to the ramie frame, namely the bast fiber collecting frame of the sequencing batch decorticator. The transport unit transports the ramie frame to the degumming unit for squeezing and degumming processing. The ramie fibers are then cleaned and recovered by the bast fiber cleaning unit.

The sorting unit is constituted by the ramie sorting platform 1, which is located left to the automatic ramie stem separation machine 3. The ramie sorting platform 1 can be the ramie sorting platform Model ZMFJ-1 developed jointly by Wuhan Textile University and Xinnong Ramie Co., Ltd, that is mainly constituted by sorting platform pivot, sorting platform driving mechanism, flat belt, and sorting platform stand.

The peeling unit is constituted by the sequencing batch decorticator 2 and three machines with the same structure, namely the automatic ramie stem separation machines 3, wherein the sequencing batch decorticator is located the beginning end of the L type standing roller type transport platform 15, followed immediately by the automatic ramie stem separation machine. The sequencing batch decorticator 2 can be the sequencing batch decorticator Model XBM-1D developed jointly by Wuhan Textile University and Xinnong Ramie Co., Ltd, that is mainly constituted by the bast fiber collecting frame of the sequencing batch decorticator 11, the stem inlet of the sequencing batch decorticator 12, the hoisting device, the rotating device, boon separating and recovering device, and the bast fiber cutting device. The automatic ramie stem separation machine 3 can be the automatic ramie stem separation machine Model ZDZMF-3 developed jointly by Wuhan Textile University and Xinnong Ramie Co., Ltd, that is mainly constituted by the stem inlet of the automatic ramie stem separation machine 13, the separation machine stand, the boon-and-bark separating device of the separation machine, and the bast fiber collecting and transporting mechanism. The L type standing roller type transport platform 15 can be the standing roller type transport platform Model GZSS-L developed jointly by Wuhan Textile University and Xinnong Ramie Co., Ltd, that is mainly constituted by the driving mechanism, the roller, and the stand.

The transport unit is constituted by roller type transport platform 5 and chaining transport device 20, wherein the roller type transport platform 5 is distributed right to the automatic ramie stem separation machine 3 and both front and rear sides of the stamping machine 6, and the chaining transport device 20 is located over the degumming and washing pool 19. The roller type transport platform 5 can be the roller type transport platform Model GZSS-1 developed jointly by Wuhan Textile University and Xinnong Ramie Co., Ltd, that is mainly constituted by the driving mechanism, the roller, and the stand. The chaining transport device 20 can be the chaining transport device Model GLSS developed jointly by Wuhan Textile University and Xinnong Ramie Co., Ltd, that is mainly constituted by the stand, transport track, and the slidable hook.

The degumming unit is constituted by the degumming and washing pool 19 and four machines with the same structure, namely the stamping machine 6, wherein the stamping machine 6 is located at the end of the roller type transport platform 5, and the degumming and washing pool 19 is located 30 m away and right front of the stamping machine 6. The degumming unit performs firstly the stamping machine squeezing processing in the degumming process, by which 80% of the gum can be removed, and then performs the degumming and washing processing. With the whole process, the degumming ratio can be up to 95% and the polluted wastewater caused by degumming can be reduced significantly. The stamping machine 6 can be the stamping machine Model XZMFX-3 developed jointly by Wuhan Textile University and Xinnong Ramie Co., Ltd, that is mainly constituted by the stamping machine stand, the hydraulic motor, the squeezing platform of the stamping machine 17, the mechanical hand of the stamping machine 18, the squeezing and impacting device of the stamping machine.

The ramie frame convey unit is constituted by the first mechanical hand 4 and the second mechanical hand 7, wherein the first mechanical hand 4 is located over the roller type transport platform 5, fixed to the ground by the stand and across the L type standing roller type transport platform 15. The second mechanical hand 7 is located at the rear of the roller type transport platform 5 and fixed to the ground by the stand.

The bast fiber cleaning unit is constituted by the third mechanical hand 9 and two machines with the same structure, namely the ramie fiber back washing device 10, wherein the third mechanical hand 9 is located left to the fiber back washing device and fixed to the ground by the stand. The bast fiber cleaning unit can clean up the residual chemicals on the ramie fibers in the ramie fiber cleaning process. At the same time, the process of performing batch washing can separate the residual boons in the ramie fibers by washing. The ramie fiber back washing device 10 can be the ramie fiber back washing device Model ZMXFC-1 developed jointly by Wuhan Textile University and Xinnong Ramie Co., Ltd, that is mainly constituted by the ramie fiber cleaning tank, the water supply device, the stand, and the cap inversing device. The soluble gum can be partially squeezed out from the ramie in the mechanical squeezing and water washing process to fiber-separating the raw fibers partially.

The ramie fiber back washing device 10 is located the very right side of the factory building and near the chaining transport device.

All of the first mechanical hand 4, the second mechanical hand 7, and the third mechanical hand 9 are the JXS-01 series mechanical hands developed jointly by Wuhan Textile University and Xinnong Ramie Co., Ltd, which are controlled using hydraulic system, and are steady, safe and reliable in working process.

Figure 7:
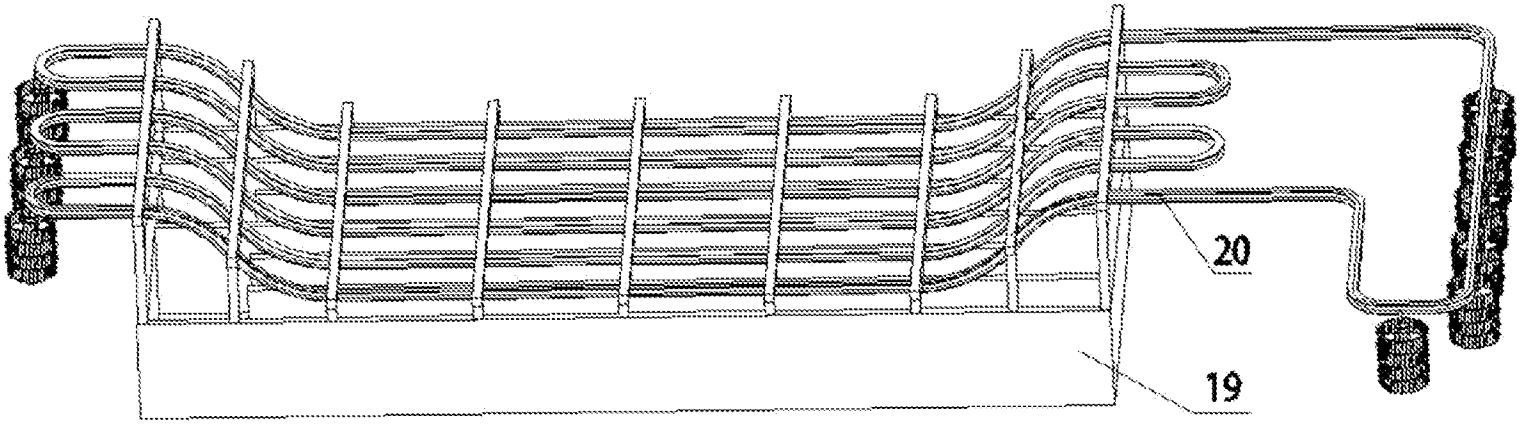
FIG. 7 is a schematic view of the structure of the washing and degumming section in FIG. 2.

In the apparatus of the present invention, the degumming and washing device 8 is right below the chaining transport device 20 in FIG. 7.

Figure 4:
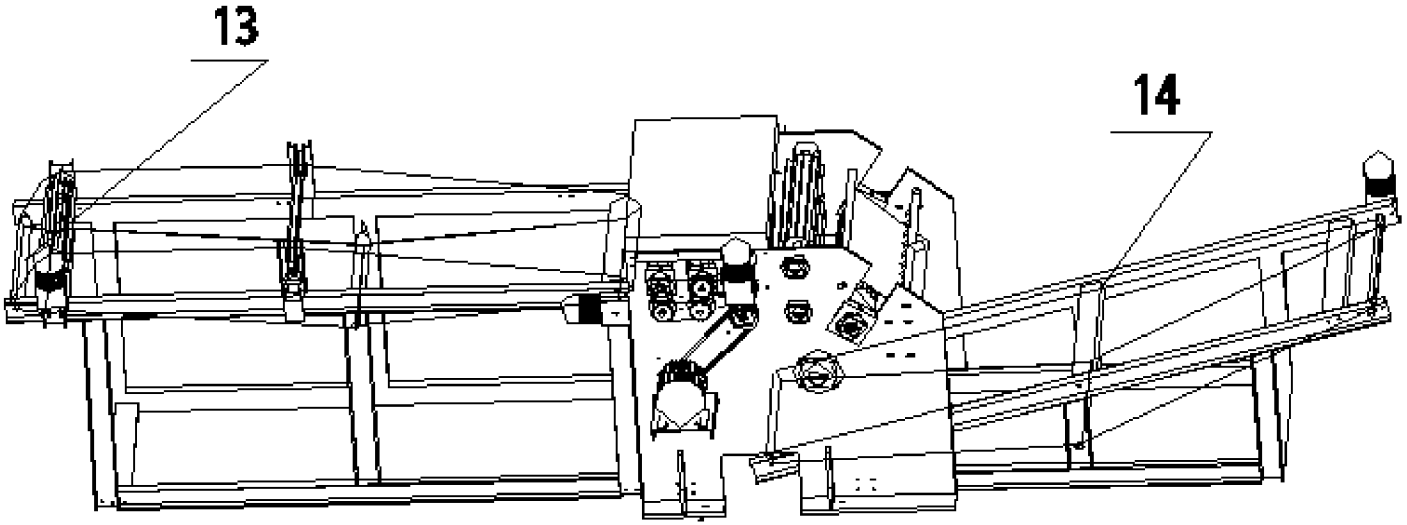
FIG. 4 is a schematic view of the automatic stem separation machine in FIG. 2.

In the apparatus of the present invention, the bast fiber collecting and transporting configuration of the automatic ramie stem separation machine 14 is at the right end of the automatic ramie stem separation machine 3 in FIG. 4.

Figure 5:
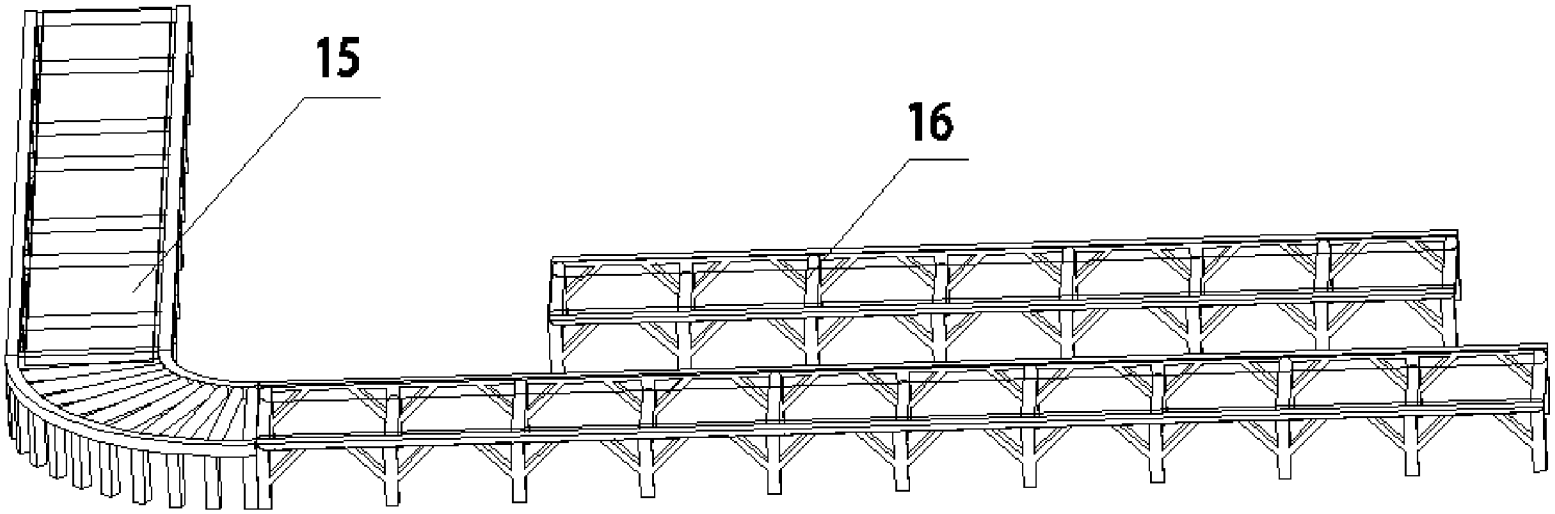
FIG. 5 is the roller type transport platform in FIG. 2.
Figure 6:
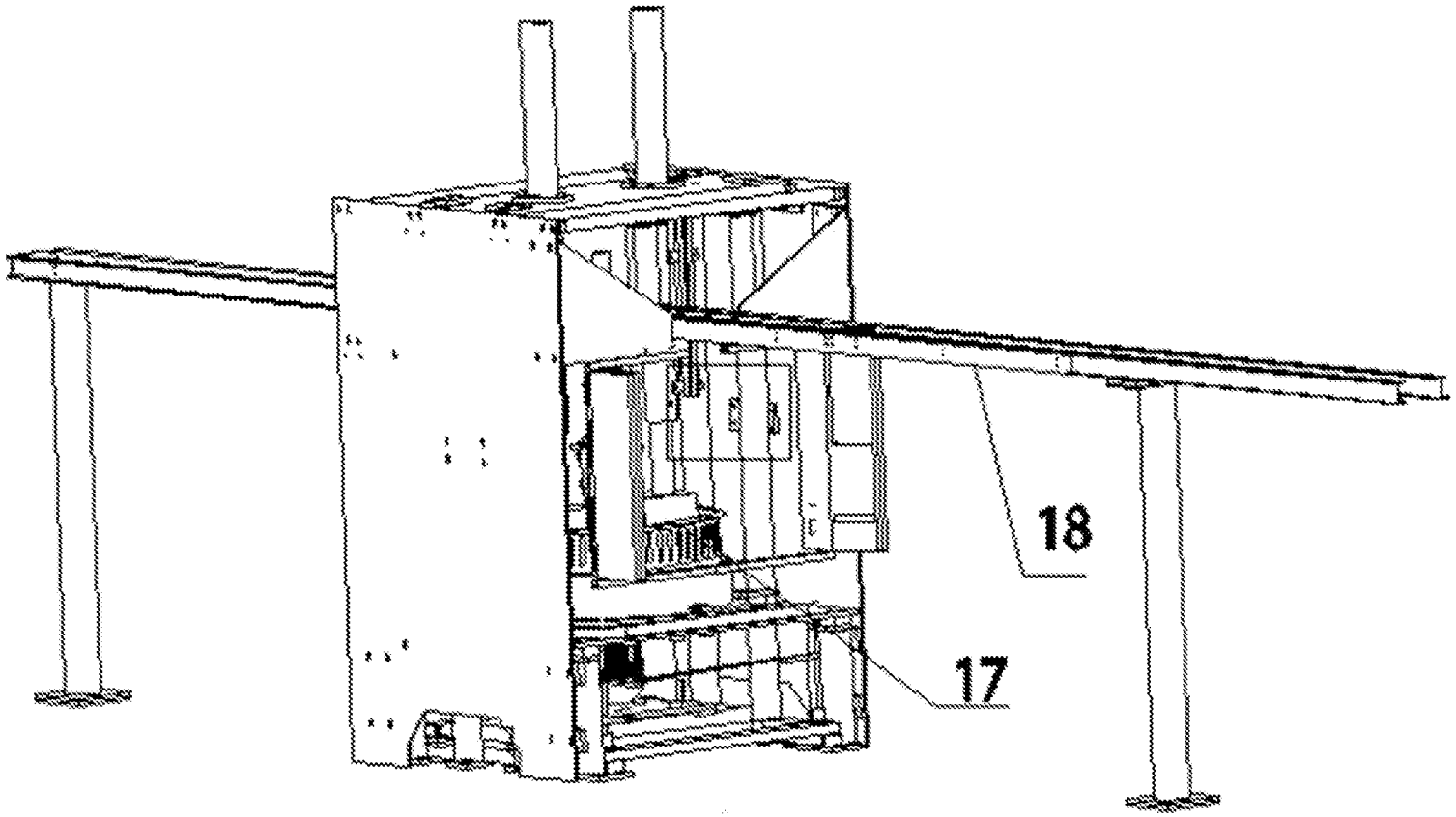
FIG. 6 is a schematic view of the stamping machine in FIG. 2.

In the apparatus of the present invention, the I type roller type transport platform 16 is right over the L type roller type transport platform 15 in FIG. 5.

Figure 8:
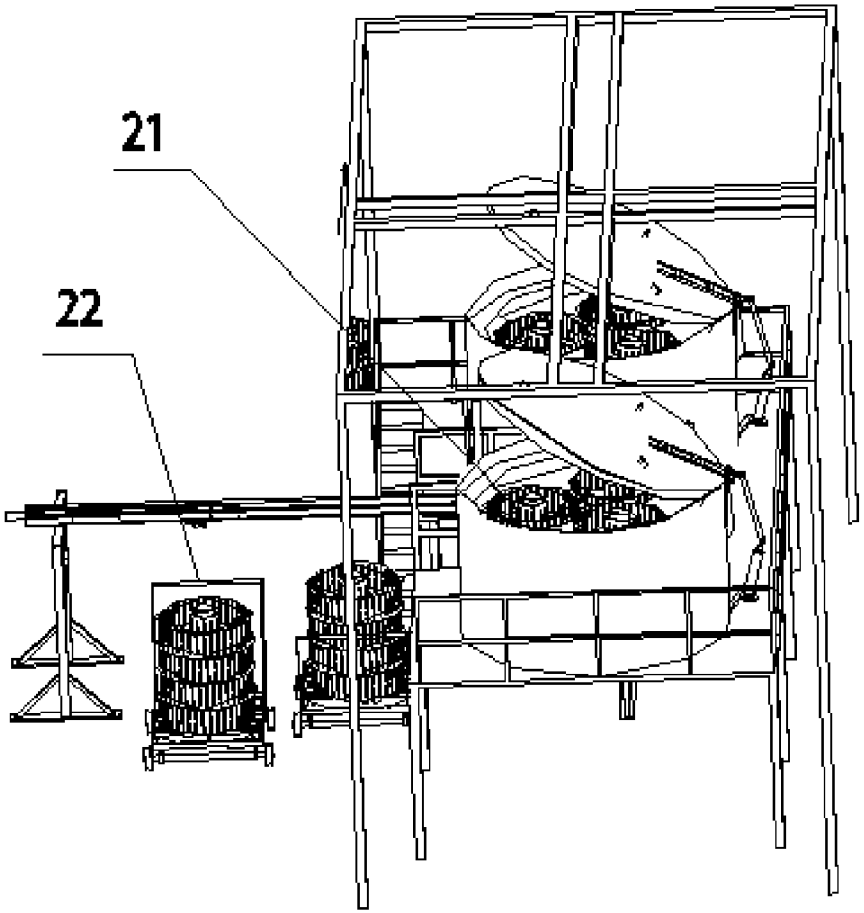
FIG. 8 is a schematic view of the structure of the ramie fiber cleaning unit in FIG. 2.

In the apparatus of the present invention, the ramie fiber cleaning tank 21 is at the lower part of the ramie fiber back washing device 10 in FIG. 8.

In the apparatus of the present invention, the trolley 22 is at the left part of the ramie fiber back washing device 10 in FIG. 8.

The present invention will be further described below in combination with Examples and accompanied drawings, without limiting the present invention.

Example 1

The degumming processing was performed using the process flow shown in FIG. 1 and the apparatus shown in FIGS. 2-8. The manually peeled ramie marketed in Xianning City, Hubei Province was purchased. 500 kg of the manually peeled ramie was placed into the waste alkali bath pool in a bath ratio of 1:20 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The manually peeled ramie treated in the waste alkali bath was placed into the anaerobic washing pool in a bath ratio of 1:20 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment. Then, the manually peeled ramie treated in the anaerobic washing pool was placed into the aerobic washing pool in a bath ratio of 1:20 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment. The aerobic washing pool was kept in the aerated state in the immersion period with the aerated dissolved oxygen of 3 to 5 mg/L.

Next, the manually peeled ramie treated in the aerobic washing pool was placed into the alkali-hydrogen peroxide one bath scouring-bleaching pool in a bath ratio of 1:20 (weight volume ratio), and immersed in a solution of 2 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:20 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 15 U (International units) in a bath ratio of 1:20 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 178, a $BOD_5$ of 33, a chromaticity of 11, a SS of 29, and a pH of 7.6. The effluents were returned back to the fiber-separating and washing pool for repeated use.

The degummed ramie obtained after dehydration and baking was tested for fiber quality. The results were shown in Table 1.

Example 2

The degumming processing was performed using the process flow shown in FIG. 1 and the apparatus shown in FIGS. 2-8. The manually peeled ramie marketed in Xianning City, Hubei Province was purchased. 500 kg of the manually peeled ramie was placed into the waste alkali bath pool in a bath ratio of 1:17 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The manually peeled ramie treated in the waste alkali bath was placed into the anaerobic washing pool in a bath ratio of 1:17 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment. Then, the manually peeled ramie treated in the anaerobic washing pool was placed into the aerobic washing pool in a bath ratio of 1:17 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment. The aerobic washing pool was kept in the aerated state in the immersion period with the aerated dissolved oxygen of 3 to 5 mg/L.

Next, the manually peeled ramie treated in the aerobic washing pool was placed into the alkali-hydrogen peroxide one bath scouring-bleaching pool in a bath ratio of 1:17 (weight volume ratio), and immersed in a solution of 2.8 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:17 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 20 U (International units) in a bath ratio of 1:17 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 198, a $BOD_5$ of 40, a chromaticity of 15, a SS of 32, and a pH of 7.2. The effluents were returned back to the fiber-separating and washing pool for repeated use.

The degummed ramie obtained after dehydration and baking was tested for fiber quality. The results were shown in Table 1.

Example 3

The degumming processing was performed using the process flow shown in FIG. 1 and the apparatus shown in FIGS. 2-8. The manually peeled ramie marketed in Xianning City, Hubei Province was purchased. 500 kg of the manually peeled ramie was placed into the waste alkali bath pool in a bath ratio of 1:22 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The manually peeled ramie treated in the waste alkali bath was placed into the anaerobic washing pool in a bath ratio of 1:22 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment. Then, the manually peeled ramie treated in the anaerobic washing pool was placed into the aerobic washing pool in a bath ratio of 1:22 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment. The aerobic washing pool was kept in the aerated state in the immersion period with the aerated dissolved oxygen of 3 to 5 mg/L.

Next, the manually peeled ramie treated in the aerobic washing pool was placed into the alkali-hydrogen peroxide one bath scouring-bleaching pool in a bath ratio of 1:22 (weight volume ratio), and immersed in a solution of 2.2 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:22 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 18 U (International units) in a bath ratio of 1:22 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 162, a $BOD_5$ of 37, a chromaticity of 17, a SS of 26, and a pH of 7.3. The effluents were returned back to the fiber-separating and washing pool for repeated use.

The degummed ramie obtained after dehydration and baking was tested for fiber quality. The results were shown in Table 1.

Example 4

The degumming processing was performed using the process flow shown in FIG. 1 and the apparatus shown in FIGS. 2-8. The fresh ramie in the Ramie Planting Field of Xianning City, Hubei Province was reaped. 500 kg of the fresh ramie was placed into the waste alkali bath pool in a bath ratio of 1:25 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The ramie treated in the waste alkali bath was placed into the anaerobic washing pool in a bath ratio of 1:25 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment. Then, the manually peeled ramie treated in the anaerobic washing pool was placed into the aerobic washing pool in a bath ratio of 1:25 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment.

The aerobic washing pool was kept in the aerated state in the immersion period with the aerated dissolved oxygen of 3 to 5 mg/L.

Next, the ramie treated in the aerobic washing pool was placed into the alkali-hydrogen peroxide one bath scouring-bleaching pool in a bath ratio of 1:25 (weight volume ratio), and immersed in a solution of 1.8 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:25 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 10 U (International units) in a bath ratio of 1:25 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 186, a $BOD_5$ of 39, a chromaticity of 12, a SS of 32, and a pH of 6.9. The effluents were returned back to the fiber-separating and washing pool for repeated use.

The degummed ramie obtained after dehydration and baking was tested for fiber quality. The results were shown in Table 1.

Example 5

The degumming processing was performed using the process flow shown in FIG. 1 and the apparatus shown in FIGS. 2-8. The manually peeled ramie originated in Yueyang City, Hunan Province was purchased. 500 kg of the manually peeled ramie was placed into the waste alkali bath pool in a bath ratio of 1:15 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The manually peeled ramie treated in the waste alkali bath was placed into the anaerobic washing pool in a bath ratio of 1:15 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment. Then, the manually peeled ramie treated in the anaerobic washing pool was placed into the aerobic washing pool in a bath ratio of 1:15 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment. The aerobic washing pool was kept in the aerated state in the immersion period with the aerated dissolved oxygen of 3 to 5 mg/L.

Next, the manually peeled ramie treated in the aerobic washing pool was placed into the alkali-hydrogen peroxide one bath scouring-bleaching pool in a bath ratio of 1:15 (weight volume ratio), and immersed in a solution of 2.8 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:15 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 30 U (International units) in a bath ratio of 1:15 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 172, a $BOD_5$ of 36, a chromaticity of 15, a SS of 28, and a pH of 7.2. The effluents were returned back to the fiber-separating and washing pool for repeated use.

The degummed ramie obtained after dehydration and baking was tested for fiber quality. The results were shown in Table 1.

Example 6

The degumming processing was performed using the process flow shown in FIG. 1 and the apparatus shown in FIGS. 2-8. The manually peeled ramie originated in Ruanjiang City, Hunan Province was purchased. 500 kg of the manually peeled ramie was placed into the waste alkali bath pool in a bath ratio of 1:18 (weight volume ratio) and immersed for 8 h. The solution in the pool was the alkaline wastewater discharged from the alkali-hydrogen peroxide one bath scouring-bleaching. Then, the degumming wastewater was precipitated by separate treatment, after which the resulted sludge was burnt directly and the supernatant was discharged into the sewage treatment unit.

The degumming wastewater was pumped into the sewage treatment unit, followed by the sewage treatment in the conditioning pool, the anaerobic pool, the first precipitation pool, the aerobic pool, the second precipitation pool etc.

The manually peeled ramie treated in the waste alkali bath was placed into the anaerobic washing pool in a bath ratio of 1:18 (weight volume ratio) and washed by immersion at ambient temperature for 8 h. The anaerobic washing pool was circulated with the anaerobic pool for sewage treatment, and the solution used for washing was with the same composition as that of the solution in the anaerobic pool for sewage treatment.

Then, the manually peeled ramie treated in the anaerobic washing pool was placed into the aerobic washing pool in a bath ratio of 1:18 (weight volume ratio) and washed by immersion at ambient temperature for 8 h. The aerobic washing pool was circulated with the aerobic pool for sewage treatment, and the solution used for washing was with the same composition as that of the solution in the aerobic pool for sewage treatment. The aerobic washing pool was kept in the aerated state in the immersion period with the aerated dissolved oxygen of 3 to 5 mg/L.

Next, the manually peeled ramie treated in the aerobic washing pool was placed into the alkali-hydrogen peroxide one bath scouring-bleaching pool in a bath ratio of 1:18 (weight volume ratio), and immersed in a solution of 2.6 g/L NaOH and 0.5 g/L $H_2O_2$ to react at the temperature of 80° C. for 2 h. The reaction liquid was discharged into the waste alkali bath pool. Then, the manually peeled ramie treated in the alkali-hydrogen peroxide one bath scouring-bleaching pool was placed into the fiber-separating and washing device in a bath ratio of 1:18 (weight volume ratio). The fiber-separating in the present invention can be performed either by rolling and rubbing manually or in a mechanical way. The washing time was 4 h.

Finally, the raw fibers treated by fiber-separating and washing were immersed in a solution with a cellulose concentration of 22 U (International units) in a bath ratio of 1:18 (weight volume ratio) and reacted at the temperature of 55° C. for 2 h so as to perform the bio-enzyme washing.

The effluents from the waste alkali bath, fiber-separating and washing, and bio-enzyme washing were pumped into the conditioning pool for sewage treatment, and treated in the anaerobic pool, the first precipitation pool, the aerobic pool, the second precipitation pool, after which the effluents had a COD of 182, a $BOD_5$ of 41, a chromaticity of 15, a SS of 35, and a pH of 7.4. The effluents were returned back to the fiber-separating and washing pool for repeated use.

The degummed ramie obtained after dehydration and baking was tested for fiber quality. The results were shown in Table 1.

TABLE 1

Degummed Ramie Fiber Quality Test Results

| | Single Fiber Fineness | Metric Number | Fiber bundle breaking strength | residual gum content |
|---|---|---|---|---|
| Measurement units | dtex | Nm | CN/dtex | % |
| National standard | ≤8.33 | ≥1200 | ≥3.50 | ≤5.00 |
| Example 1 | 5.76 | 1680 | 4.50 | 3.82 |
| Example 2 | 5.82 | 1750 | 4.21 | 4.17 |
| Example 3 | 5.13 | 1720 | 4.46 | 4.08 |
| Example 4 | 5.17 | 1810 | 4.39 | 3.42 |
| Example 5 | 5.87 | 1670 | 4.40 | 4.12 |
| Example 6 | 5.30 | 1851 | 4.42 | 4.38 |

As can be seen from Table 1, the degumming ramie fibers obtained by the degumming method provided in the present invention had relatively good qualities. The fiber linear density, the fiber bundle breaking strength, and the residual gum content met the national standard for degummed ramie (GB/T 20793-2006).

The ramie in the above examples may also be replaced by the ramie of other origins.

In the above examples, the degumming waste liquid after fiber-separating and washing and cellulose washing was pumped into the conditioning pool, in which the degumming wastewater had a COD of 1500 to 3000 significantly lower than the COD level of 8000 to 10000 in the conditioning pool of the traditional chemical degumming wastewater treatment system. The effluent from the second precipitation pool had a COD of not higher than 200, which can meet the requirements for water used in the fiber-separating and washing of the present process. After the treatment in conventional sewage treatment system, the effluent can reach the discharge standard B of Grade 1.

What is claimed is:

1. A method for degumming and fiber-separating ramie, characterized in that the method includes:

(1) waste alkali bath step, in which raw fibers are immersed in alkaline wastewater discharged from alkali-hydrogen peroxide bath scouring-bleaching at ambient temperature for 8 h;

(2) anaerobic circle step, in which the raw fibers treated in the waste alkali bath are immersed in an anaerobic water pool in a bath ratio of 1:15 to 25, and washed at an ambient temperature for 8 h;

(3) aerobic circle step, in which the raw fibers washed in the anaerobic water pool are immersed in an aerobic water pool in a bath ratio of 1:15 to 25, and washed at the ambient temperature for 8 h;

(4) alkali-hydrogen peroxide bath scouring-bleaching step, in which the raw fibers treated in the aerobic circle step are immersed in a solution comprising 1 to 10 g/L NaOH and 0 to 2 g/L $H_2O_2$ in a bath ratio of 1:15 to 25, and reacted at a temperature of 70 to 100° C. for 2 h;

(5) fiber-separating and washing step, in which the raw fibers washed in the alkali-hydrogen peroxide bath scouring-bleaching step are treated by a fiber-separating and washing device with a washing time of 4 h, which is performed either by rolling and rubbing manually or in a mechanical way; and (6) bio-enzyme washing step, in which the raw fibers treated in the fiber-separating and washing step are immersed in a solution having a cellulase concentration of 5 to 30 U in a bath ratio of 1:15 to 25 and reacted at a temperature of 55° C. for 2 h to reach the degumming and fiber-separating of the raw ramie fibers.

2. The method for degumming and fiber-separating the ramie according to claim 1, characterized in that: the ramie degumming process and degumming wastewater treatment are performed integratively, and effluent from the alkali-hydrogen peroxide bath scouring-bleaching is introduced into the waste alkali bath and used for the immersion of the raw fibers; water used in the anaerobic washing step is circulated with the anaerobic pool for sewage treatment; water used in the aerobic washing step is circulated with the aerobic pool for the sewage treatment; effluents from the waste alkali bath, fiber-separating and washing, and bio-enzyme washing are recycled after treatment in a sewage treatment system, so that no sewage is discharged.

3. The method for degumming and fiber-separating the ramie according to claim 2, characterized in that: the degumming process is a continuous operation, and chemicals in the alkali-hydrogen peroxide bath scouring-bleaching step are repeatedly used to reduce the discharge of degumming chemicals every time.

4. The method for degumming and fiber-separating the ramie according to claim 1, characterized in that: effluent from the alkali-hydrogen peroxide bath scouring-bleaching is polluted wastewater, and a majority of the COD therein is precipitated by flocculation after being used in the waste alkali bath, to form sluge to be treated separately, and supernatant is then discharged into a sewage treatment system so as to reduce the load of the sewage treatment system.

5. The method for degumming and fiber-separating the ramie according to claim 1, characterized in that: a soluble gum is partially squeezed out from the ramie in the mechanical squeezing and water flow washing process to fiber-separate the raw fibers partially.

6. The method for degumming and fiber-separating the ramie according to claim 1, characterized in that: the cellulase is selected from the group consisting of an acidic cellulase, a neutral cellulase and an alkaline cellulase, and is not limited by the pH value.

* * * * *